United States Patent [19]

Stringfellow et al.

[11] 4,127,834

[45] Nov. 28, 1978

[54] TEMPERATURE COMPENSATING APPARATUS FOR MICROWAVE OSCILLATORS AND THE LIKE

[75] Inventors: Martin S. Stringfellow, Tempe; Michael K. Waldo, Phoenix, both of Ariz.

[73] Assignee: Motorola, Inc., Schaumburg, Ill.

[21] Appl. No.: 828,715

[22] Filed: Aug. 29, 1977

[51] Int. Cl.[2] ..... H01P 1/30; H01P 7/06

[52] U.S. Cl. ..... 333/83 T; 331/176

[58] Field of Search ..... 333/82 BT, 83 T; 331/176; 315/39.59

[56] References Cited

U.S. PATENT DOCUMENTS

| | | | |
|---|---|---|---|
| 3,528,042 | 9/1970 | Weinberger | 333/83 T |
| 3,529,267 | 9/1970 | Gunderson et al. | 333/83 T |
| 3,665,341 | 5/1972 | Sekine et al. | 331/176 X |

*Primary Examiner*—Paul L. Gensler

*Attorney, Agent, or Firm*—Eugene A. Parsons

[57] ABSTRACT

A housing with a microwave cavity and an external opening defined therein, a tubular waveguide section affixed in said opening with a tuning rod slideably positioned therein and an outer end affixed to an outer end of a sleeve mounted in surrounding relationship thereto with the inner end of the sleeve affixed to the housing. The sleeve and tuning rod are formed of dielectric material so that temperature changes on the sleeve cause movement of the rod in the cavity and compensate for changes in the resonant frequency of the cavity while the rod and the waveguide cooperate to prevent radiation leakage.

10 Claims, 1 Drawing Figure

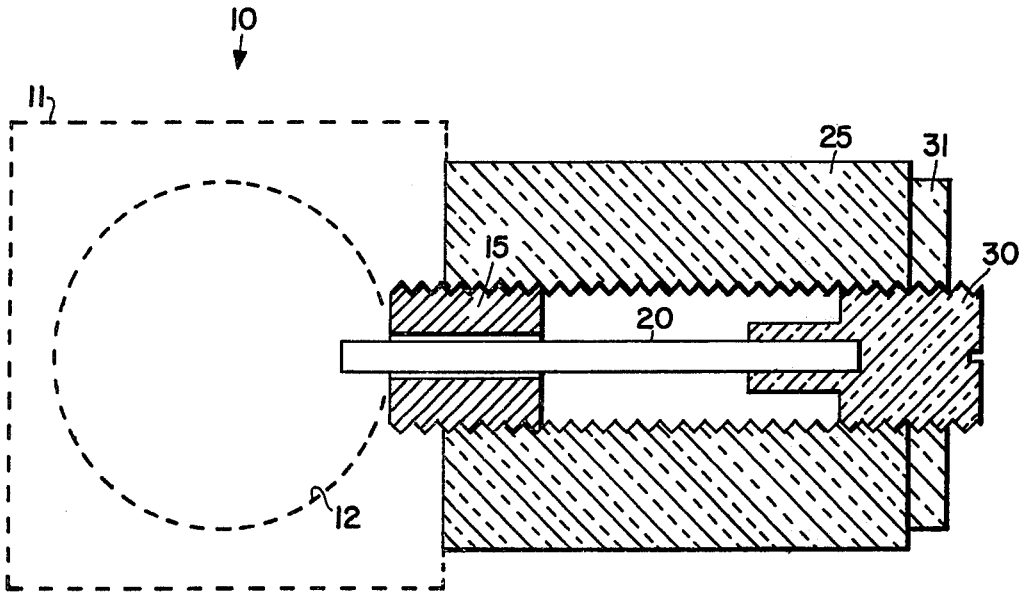
10
11
25
31
15
30
20
12

TEMPERATURE COMPENSATING APPARATUS FOR MICROWAVE OSCILLATORS AND THE LIKE

BACKGROUND OF THE INVENTION

In microwave oscillators and the like utilizing microwave cavities in housings it is necessary to provide some temperature compensation for changes in the resonant frequency of the cavity due to temperature changes of the housing or other components. In prior art structures it is common to slideably mount a tuning rod in an opening in the housing by means of an external compensating device which causes movement of the rod in the cavity in response to temperature changes of the compensating device. In many instances, to prevent radiation leakage through the opening in the housing, the structure is partially formed from or encircled by metal. This metal shields the structure to prevent radiation but does not prevent losses of energy through the opening. Further, these devices are generally complicated and expensive to manufacture.

SUMMARY OF THE INVENTION

The present invention pertains to apparatus for temperature compensating the frequency drift in microwave cavity oscillators and the like and includes a tubular waveguide section extending through an opening in the housing so as to communicate with the cavity, a tuning rod slideably positioned in said waveguide with a first portion thereof extending into the cavity and a second portion extending outwardly from said waveguide exterior to said housing, said tuning rod and said waveguide cooperating to minimize radiation leakage therethrough, and compensator means affixed to the housing and the second or exterior portion of said tuning rod and slideably mounting said tuning rod in said waveguide for movement of the first portion of said tuning rod in the cavity in response to temperature changes of the compensator means.

It is an object of the present invention to provide new and improved apparatus for temperature compensating the frequency drift in microwave cavity oscillators and the like.

It is a further object of the present invention to provide apparatus for temperature compensating the frequency drift in microwave cavity oscillators and the like, which apparatus includes a dielectric sleeve compensator and below cutoff dielectrically loaded waveguide for leakage reduction.

It is a further object of the present invention to provide apparatus for temperature compensating the frequency drift in microwave cavity oscillators and the like which are relatively inexpensive and simple to manufacture.

These and other objects of this invention will become apparent to those skilled in the art upon consideration of the accompanying specification, claims and drawing.

BRIEF DESCRIPTION OF THE DRAWING

The single FIGURE is a sectional view of a microwave cavity oscillator having temperature compensating apparatus attached thereto embodying the present invention.

DESCRIPTION OF THE PREFERRED EMBODIMENT

Referring to the FIGURE, the numeral 10 generally designates a microwave device, which may be an oscillator or the like, including a housing 11 and a cavity 12 defined therein. The housing 11 also defines an external opening in communication with the cavity 12, which has a tubular waveguide section 15 threadedly engaged therein. In this embodiment, the inner surface of the opening is threaded and the outer periphery of the waveguide section 15 is threaded for threadedly engaging the waveguide section in the opening in the housing 11. However, it should be understood that the waveguide section might be affixed to the housing 11 by any well known method, such as welding, pressfitting, etc., and the present method of attachment is illustrated because of its simplicity and ease of construction. Also, in this embodiment the waveguide section 15 has a central passageway therethrough with a generally circular cross-section, but it should be understood that other configurations might be designed by those skilled in the art. The waveguide section 15 should be constructed of some electrically conductive material, such as aluminum or the like.

An elongated tuning rod 20 is slideably positioned in the passageway of the waveguide section 15 so that one end thereof protrudes into the cavity 12 and the opposite end extends outwardly exterior of the housing 11. While the tuning rod 20 may be devised with a variety of configurations, in the present embodiment it has a circular cross-section and is formed of dielectric material, such as a ceramic sold under the tradename "LUCALOX" by the General Electric Corporation. At least the portion of the rod 20 extending through the passageway in the waveguide section 15 must be made of dielectric material to dielectrically load the waveguide section 15 and minimize or prevent radiation leakage therethrough. The dimensions of the waveguide section 15 are such that the loaded waveguide is cut off at the RF frequency of operation. For example, in the present embodiment the oscillator 10 is operating at approximately 14 GHz, the length of the passageway through the waveguide 15 is approximately one-quarter inch, the diameter of the passageway is approximately one-tenth of an inch and the diameter of the tuning rod 20 is approximately 0.095 inches. It will, of course, be understood that dimensions and materials specified herein are for exemplary purposes only and may be altered by those skilled in the art.

Compensator means are affixed to the outer end of the rod 20 in the following fashion. A sleeve 25 having threads on the inner diameter thereof is threadedly engaged with the outer threads on an outwardly projecting portion of the waveguide section 15. This threaded engagement mounts the sleeve 25 in outwardly projecting relationship generally coaxial with the rod 20. A plug 30 having threads on the outer surface thereof is threadedly engaged in the sleeve 25 and is fixedly attached to the outer end of the rod 20. Thus, turning the plug 30 causes movement along the axial length of the sleeve 25 and adjusts the amount of tuning rod 20 extending into the cavity 12. The plug 30 and a locknut 31 threadedly engaged thereon form adjustable means for altering the resonant frequency of the cavity 12. It will, of course, be understood that many other types of apparatus might be utilized to slideably mount the tuning rod 20 in the passageway of the waveguide 15 and to fixedly attach the outer end of the tuning rod 20 to the outer end of the sleeve 25. Also, while the sleeve 25 completely surrounds the rod 20 and protects the device from foreign material, such as dust and the like, other configurations might be devised by those skilled in the art.

In this embodiment the sleeve 25 is formed of dielectric materials, such as nylon or the like, and any alterations in the length due to ambient temperatures will alter the position of the rod 20 in the cavity 12 and compensate for frequency drift due to the effects of the ambient temperature on the housing 11. By proper choice of materials for the tuning rod 20 and the sleeve 25, maximum compensation can be obtained. Further, the sleeve 25 can be formed of dielectric material since the waveguide section 15 minimizes, or prevents, radiation leakage and further shielding is not required. While the entire rod 20 is made of dielectric material in this embodiment and at least the portion within the passageway of the waveguide 15 must be made of dielectric material to provide the dielectric loading of the waveguide section 15, it is of course understood that the end of the rod 20 extending into the cavity 12 might be formed of other material, if desired, such as metal or the like, to further enhance the tuning characteristics.

Therefore, improved apparatus for temperature compensating the frequency drift in microwave cavity oscillators and the like is illustrated which is relatively simple and inexpensive to manufacture. Further, the apparatus incorporates a dielectric sleeve compensator and a below cutoff waveguide for radiation leakage reduction. Radiation from the RF cavity 12 is minimized, or eliminated, by using a dielectrically loaded metal waveguide section and, because of this radiation reduction, a dielectric sleeve can be utilized as the compensating element for greater thermal expansion.

While we have shown and described a specific embodiment of this invention, further modifications and improvements will occur to those skilled in the art. We desire it to understood, therefore, that this invention is not limited to the particular form shown and we intend in the appended claims to cover all modifications which do not depart from the spirit and scope of this invention.

What is claimed is:

1. In microwave oscillators and the like employing a housing with a microwave cavity therein, apparatus for temperature compensating the frequency drift comprising:

(a) a tubular waveguide section mounted in the housing so as to extend therethrough into communication with the cavity;

(b) a tuning rod slideably positioned in said waveguide with a first portion thereof extending into the cavity and a second portion extending outwardly from said waveguide exterior to said housing, said tuning rod and said waveguide cooperating to minimize radiation leakage therethrough; and (c) compensator means affixed to the housing and the second portion of said tuning rod and slideably mounting said tuning rod in said waveguide for movement of the first portion of said tuning rod in the cavity to alter the resonant frequency of the cavity in accordance with temperature changes of said compensator means, the alterations in resonant frequency compensating for changes in the resonant frequency covered by temperature changes of the housing.

2. Apparatus for temperature compensating frequency drift as claimed in claim 1 wherein at least the portion of the tuning rod positioned within the waveguide is formed of dielectric material.

3. Apparatus for temperature compensating frequency drift as claimed in claim 1 wherein the waveguide has an opening therethrough for receiving the tuning rod, which opening has a cross section and length adjusted to minimize radiation leakage.

4. Apparatus for temperature compensating frequency drift as claimed in claim 1 wherein the compensator means includes a substantially sleeve shaped portion positioned in generally surrounding relation to the tuning rod with one end thereof affixed relative to the housing and the other end affixed relative to the second portion of the tuning rod.

5. Apparatus for temperature compensating frequency drift as claimed in claim 4 wherein the sleeve shaped portion is formed of dielectric material.

6. Apparatus for temperature compensating frequency drift as claimed in claim 5 wherein the sleeve shaped portion is formed of nylon.

7, Apparatus for temperature compensating frequency drift as claimed in claim 1 wherein the tubular waveguide has a passageway therethrough with a generally circular cross section and the tuning rod has a generally circular cross section and is mounted generally coaxially within the passageway of said waveguide.

8. In microwave cavity oscillators and the like, apparatus for temperature compensating the frequency drift comprising:

(a) a housing defining a cavity for the oscillator and the like and further defining an external opening in communication with the cavity;

(b) a tubular waveguide section mounted in the opening in said housing so as to extend through said housing into communication with the cavity;

(c) a tuning rod slideably positioned in said waveguide with a first portion thereof extending into the cavity and a second portion extending outwardly from said waveguide exterior to said housing, said tuning rod and said waveguide cooperating to minimize radiation leakage therethrough;

(d) an elongated sleeve having one end affixed relative to said housing and postioned in generally outwardly extending relationship generally parallel to and surrounding the second portion of said tuning rod;

(e) adjustable means threadedly engaged at the outwardly extending end of said sleeve for adjusting movements along said sleeve and further affixed to the second portion of said tuning rod to slideably mount said tuning rod in said waveguide for movement of the first portion of said tuning rod in the cavity to alter the resonant frequency of the cavity in accordance with temperature changes of said sleeve, the alterations in resonant frequency compensating for changes in the resonant frequency caused by temperature changes of the housing and movement of said adjustable means along said sleeve adjusting the resonant frequency.

9. Apparatus as claimed in claim 8 wherein the waveguide is threadedly engaged in the opening in the housing and the one end of the sleeve is threadedly engaged to said waveguide.

10. Apparatus as claimed in claim 8 wherein the tuning rod and the sleeve are formed of dielectric material.

* * * * *